United States Patent [19]

Weidler et al.

[11] Patent Number: 4,553,808

[45] Date of Patent: Nov. 19, 1985

[54] ELECTRICAL TERMINAL INTENDED FOR MATING WITH A TERMINAL TAB

[75] Inventors: Charles H. Weidler, Lancaster; George E. Trout, Etters, both of Pa.

[73] Assignee: AMP Incorporated, Harrisburg, Pa.

[21] Appl. No.: 727,193

[22] Filed: Apr. 26, 1985

Related U.S. Application Data

[63] Continuation of Ser. No. 564,670, Dec. 23, 1983, abandoned.

[51] Int. Cl.[4] ..... H01R 4/24

[52] U.S. Cl. ..... 339/97 R; 339/258 R

[58] Field of Search ..... 339/97 R, 97 P, 98, 339/99 R, 258 R, 258 P

[56] References Cited

U.S. PATENT DOCUMENTS 4,262,984 4/1981 Takahashi ..... 339/99 R 4,317,608 3/1982 Dechelette ..... 339/99 R 4,405,193 9/1983 Weidler ..... 339/99 R

*Primary Examiner*—Joseph H. McGlynn

*Attorney, Agent, or Firm*—Robert W. J. Usher; F. W. Raring

[57] ABSTRACT

Stamped and formed electrical terminal has a conductor-receiving portion at one end and a mating or contact portion at the other end. A transition section is provided between the conductor-receiving portion and the contact portion, the transition section comprising flat plates which extend from the aligned parallel plates of the conductor-receiving portion and slope towards a medial plane which is parallel to and between the plates of the contact portion. The conductor-receiving portion comprises first and second pairs of contact arms which extend from the flat inclined plates of the transition section and which are joined at their ends by U-shaped sections which are in back-to-back relationship.

4 Claims, 6 Drawing Figures

ELECTRICAL TERMINAL INTENDED FOR MATING WITH A TERMINAL TAB

This application is a continuation of application Ser. No. 564,670 filed Dec. 23, 1983, now abandoned.

FIELD OF THE INVENTION

This invention relates to electrical terminals of the type having aligned parallel plate-like members at one end and conductor-receiving slots in the plate-like members and two pairs of contact arms at the other ends thereof with a transition section between the plate-like members and the contact portion. The present invention is an improvement on the terminal shown in Application Ser. No. 485,763 filed Apr. 18, 1983.

BACKGROUND OF THE INVENTION

It is common practice in the manufacture of many electrical parts such as relays, timers for appliances, and similar devices to provide terminal tabs for making electrical connections to the electrical device. The terminal tabs are usually disposed in parallel spaced apart planes and are fairly close to each other. A connector for connecting wires to the terminal tabs must therefore have contained in its housing contact terminals which will mate with the terminal tabs and which ae spaced apart by the same distances as are the terminal tabs on the electrical device. Application Ser. No. 485,763 filed Apr. 18, 1983 shows an electrical terminal having a conductor-receiving portion at one end and a mating portion at the other end for engagement with terminal tabs in aligned spaced apart planes as described above. The conductor-receiving portion comprises spaced apart parallel plates connected to each other and having aligned wire-receiving slots so that a wire can be connected to the terminal by moving the wire laterally of its axis and into the aligned slots. The mating or contact portion of the terminal comprises two pairs of contact spring arms which are arranged such that they be mated with a terminal tab that is in a plane that extends parallel to a wire which has been connected to the conductor-receiving portion of the terminal. The conductor-receiving portion is connected to the contact portion by a relatively complex transition section which is produced by bending an extension of each of the plate-like members into a U-shape with compound surfaces of continuously changing radius extending between the conductor-receiving portion and the contact portion of the terminal.

The present invention is directed to the achievement of a terminal of the general type shown in Application Ser. No. 485,763 but which has an improved transition section and which can be manufactured by relatively simple and straightforward stamping and forming operations.

A preferred embodiment of the invention comprises a stamped and formed electrical terminal of the type comprising a conductor-receiving portion and a contact portion. The conductor-receiving portion comprises first and second aligned flat plate-like members which are connected to each other, the plate-like members having aligned conductor-receiving slots so that a conductor can be moved laterally of its axis and into the conductor-receiving slots. The contact portion comprises first and second pairs of contact arms, the first pair of contact arms extending from the first plate-like member and the second pair of contact arms extending from the second plate-like member, and first and second transition sections between the first and second plate-like members and the first and second pairs of contact arms respectively. The terminal is characterized in that each transition section is flat and is inclined from its respective plate-like member towards a medial plane that is parallel to, and between, the first and second plate-like members, each transition section having convergently tapered side edges. First and second U-shaped sections are provided which extend from the first and second transition sections. Each U-shaped section comprises a web and sidewalls, the web of each U-shaped section extending from its associated transition section. The webs are on each side of the medical plane and the sidewalls extend in opposite directions away from the medial plane. The first and second pairs of contact arms extend from the sidewalls of the first and second U-shaped sections, the arms of each pair of contact arms having free ends and having opposed contact zones on their free ends so that a terminal tab can be inserted between the contact arms of the first and second pairs of contact arms and the terminal tab will be in the medial plane.

A further embodiment is characterized in that the two arms of each pair of contact arms extend convergently towards each other and the contact zones are against each other. In accordance with a further embodiment the web of each of the U-shaped sections is flat and the sidewalls extend normally from the side edges of the web.

THE DRAWING FIGURES

Figure 2:
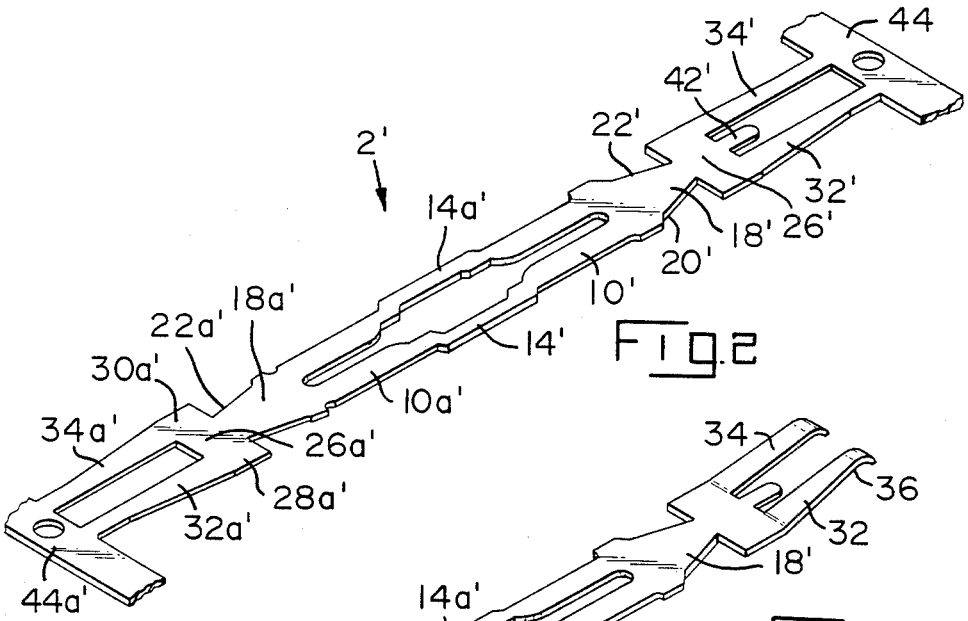
FIG. 2 is a perspective view of a flat blank from which the terminal of FIG. 1 is produced by forming operations.
Figure 3:
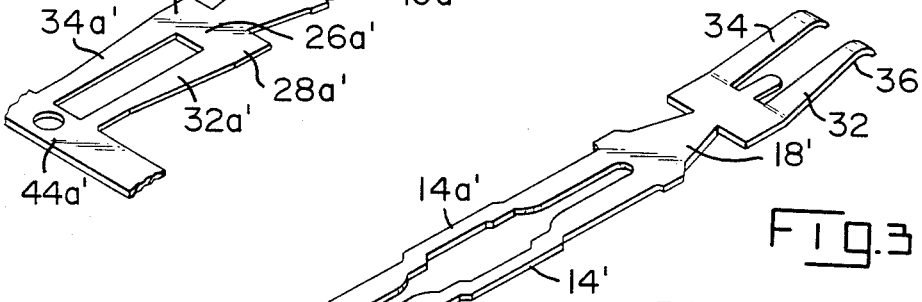
Figure 4:
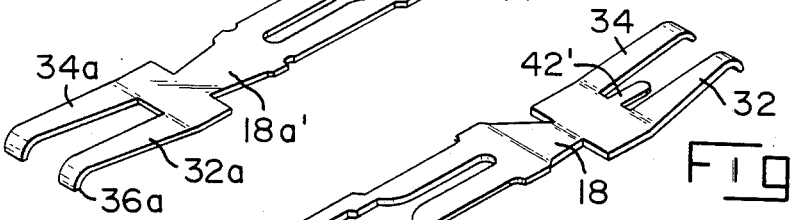
Figure 5:
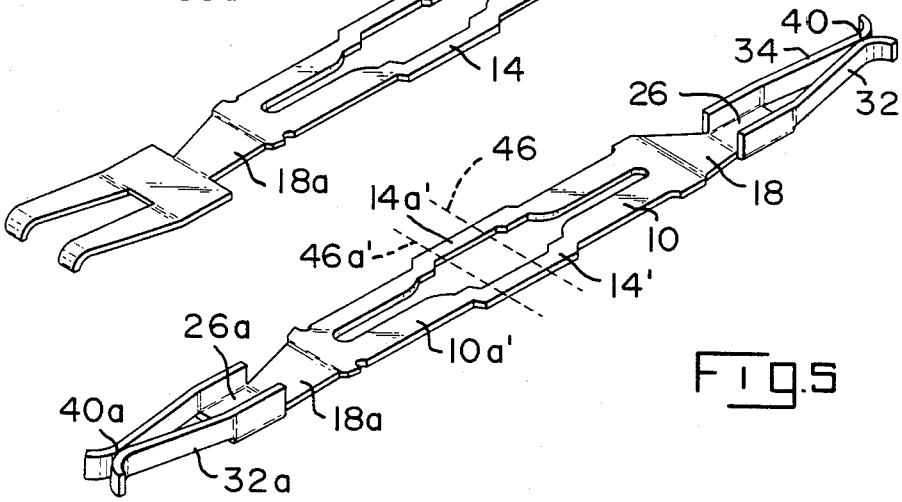

FIGS. 3, 4, and 5 are views similar to FIG. 2 but illustrating the successive forming operations which are performed on the blank prior to bending the blank into the shape of the finished terminal.

Figure 6:
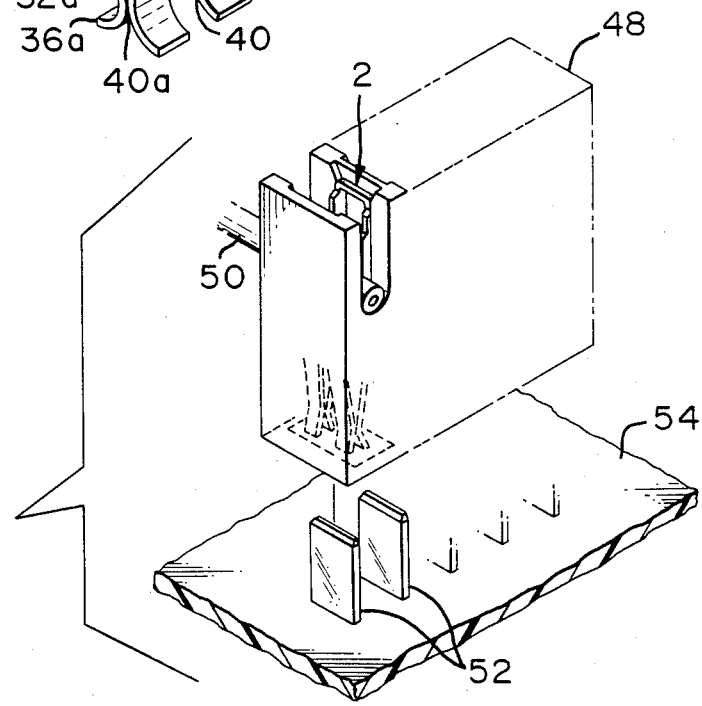

FIG. 6 is a view showing a plurality of terminal tabs on a support, such as a circuit board, and showing a connector containing terminals in accordance with the invention in alignment with the terminal tabs.

Figure 1:
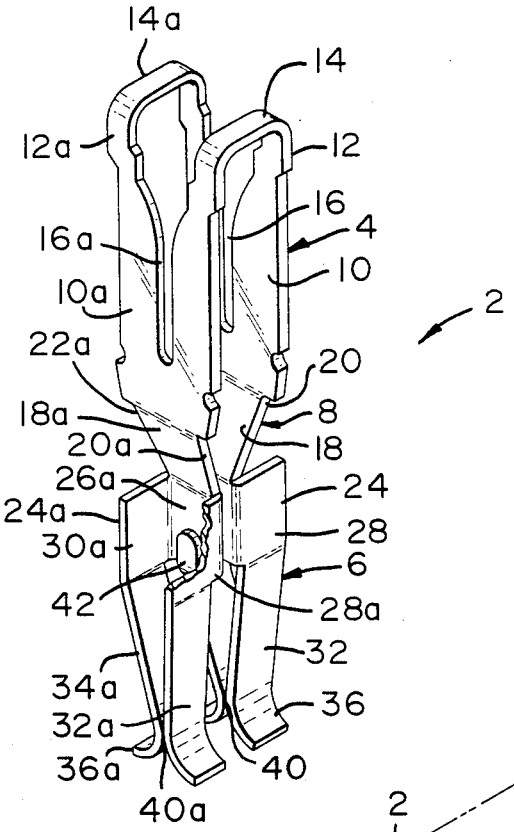
FIG. 1 is a perspective view of an electrical terminal in accordance with the invention.

Referring first to FIG. 1, a terminal 2 in accordance with the invention is of stamped and formed sheet metal, such as brass, and has a conductor-receiving portion 4, a contact or mating portion 6, and a transition section 8 which is between the conductor-receiving portion and the contact portion.

The conductor-receiving portion comprises a pair of parallel plate-like members 10, 10*a* which are connected together at their upper ends 12 (as viewed in FIG. 1) by spaced apart connecting straps 14. The plate-like members are provided with aligned wire-receiving slots 16, 16*a* so that a wire 50 can be connected to the terminal by moving the wire laterally of its axis and into the slots as shown in FIG. 6.

The transition section 8 comprises first and second flat extensions 18, 18*a* of the first and second plate-like members 10, 10*a*. The extensions 18, 18*a* are inclined inwardly towards each other and towards a medial plane which extends parallel to the planes of the plate-like members 10, 10*a* and is midway between the plate-like members. The extensions 18, 18*a* have converging side edges 20, 20*a* and 22, 22*a* which are integral with the flat web portions 26, 26*a* of U-shaped sections 24, 24*a*. The U-shaped sections have sidewalls 28, 30, 28*a*, 30*a* extending from the webs 26, 26*a*, the sidewalls extending in opposite directions from the side edges of the web portions. The web portions are parallel to each other and are on each side of, and adjacent to, the medial plane.

First and second pairs of contact arms 32, 34, 32*a*, 34*a* extend from the sidewalls of the U-shaped sections 24, 24*a* to the free ends 36, 36*a* of the terminal. The arms of each pair are inclinded towards each other and are against each other in the vicinity of contact zones 40, 40*a*. The portions which extend beyond the contact zones are curved outwardly and away from each other to facilitate mating of the terminal with a terminal tab 52.

Terminals as shown in FIG. 1 are produced by stamping and forming as shown in FIGS. 2–5. In these figures, the same reference numerals, differentiated by prime marks, are used to indicate the portions of the blank as are used to identify the parts of the finished terminal.

The terminals are produced in the form of continuous strip with the ends of each blank 2' integral with carrier strips 44, 44*a*. In addition it will be understood that each terminal is connected to the next adjacent terminals in the strip by additional carrier strips which extend from the connecting strips 14', FIG. 2. These additional connecting strips or carrier strips are not shown in the interest of clarity and facility. In the forming operation, the contact arms 32', 34', 32*a*', 34*a*', are first bent upwardly from the plane of the blank and the outer ends of the arms are curled downwardly as viewed in FIG. 3. Thereafter, the triangular extensions 18', 18*a*' are bent as shown in FIG. 4 so that the U-shaped sections 24', 24*a*' are disposed in a plane which is parallel to but beneath the plane of the central portion of the blank. Thereafter, the sidewalls of the blank are bent upwardly as shown in FIG. 5 to bring the contact zones 40*a*, 40 into alignment adjacent each other. If desired, the forming operation carried out in FIG. 3 can be such that when the final bending operation is carried out as shown in FIG. 5, the arms will be resiliently biased against each other so that a relatively high contact force will be achieved when the terminal is mated with a terminal tab 52.

In the final forming operation, the terminal is bent along bend lines 46, 46*a* to place the first and second plate-like members 10, l0*a* in parallel spaced apart planes. Advantageously, a latching ear 42 extends from the web 26' and after the final bending operation, this latching ear is bent through an angle of 180 degrees as shown in FIG. 1 so that the two sections of the terminal will be latched to each other.

Terminals as shown in FIG 1 are used with an insulating housing 48 that has the capability of accommodating a plurality of terminals 2 in side-by-side spaced apart relationship. As shown in FIG. 6, the terminal tabs for which the terminal 2 is intended are usually positioned in parallel spaced apart planes on a support member 54. By virture of the fact that the terminal 2 receives a tab 52 which is in a plane extending through the aligned slots 16, 16*a*, the terminals can be placed on relatively close centers in the connector housing 48.

It will be apparent from the foregoing that terminals in accordance with the invention can be produced by relatively simple stamping and forming operations involving only forming of the arms 32, 34, 32*a*, 34*a*, bending of the sidewalls as shown in FIG. 5, and then bending of the first and second plate-like members to produce the terminal in FIG. 1. It should be noted that the sidewalls 28, 30, 28*a*, 30*a* extend at an angle of substantially 90 degrees to their respective webs 26, 26*a* and this sidewall bending operation is carried out after the flat transition sections 18, 18*a* are bent downwardly as shown in FIG. 3. All of these bending operations can be carried out with relative ease in a progressive stamping and forming die. There is no necessity for forming operations which require the production of complex shapes in the transition zone.

I claim:

1. A stamped and formed electrical terminal of the type comprising a conductor-receiving portion and a contact portion, the conductor-receiving portion comprising first and second aligned flat plate-like members which are connected to each other, the plate-like members having aligned conductor-receiving slots so that a conductor can be moved laterally of its axis and into the conductor-receiving slots, the contact portion comprising first and second pairs of contact arms, the first pair of contact arms extending from the first plate-like member and the second pair of contact arms extending from the second plate-like member, and first and second transition sections between the first and second plate-like members and the first and second pairs of contact arms respectively, the terminal being characterized in that:

each transition section is flat and in inclined from its respective plate-like member towards a medial plane that is parallel to, and between, the first and second plate-like members, each transition section having convergently tapered side edges, first and second U-shaped sections extend from the first and second transition sections, each U-shaped section comprising a web and sidewalls, the web of each U-shaped section extending from its associated transition section, the webs being on each side of the medial plane and the sidewalls extending in opposite directions away from the medial plane, the first and second pairs of contact arms extending from the sidewalls of the first and second U-shaped section, the arms of each pair of contact arms having free ends and having opposed contact zones on their free ends whereby a terminal tab can be inserted between the contact zones of the first and second pairs of contact arms and the terminal tab will extend normal the medial plane.

2. A stamped and formed electrical terminal as set forth in claim 1 characterized in that the two arms of each pair of contact arms extend convergently towards each other and the contact zones are against each other.

3. A stamped and formed electrical terminal as set forth in claim 1 characterized in that the web of each of the U-shaped sections is flat and the sidewalls extend normally from the side edges of the web.

4. A stamped and formed electrical terminal as set forth in claim 3 characterized in that the transition sections are secured to each other by mechanical fastening means.

* * * * *